United States Patent [19]

Austin et al.

[11] Patent Number: 4,972,758

[45] Date of Patent: Nov. 27, 1990

[54] MULTIPLY ADAPTABLE MAGAZINE ASSEMBLY

[75] Inventors: Paul A. Austin, Shelburne; John H. Gaye, Essex Jct., both of Vt.

[73] Assignee: General Electric Company, Burlington, Vt.

[21] Appl. No.: 444,349

[22] Filed: Dec. 1, 1989

[51] Int. Cl.[5] ..... F41A 9/79

[52] U.S. Cl. ..... 89/34; 89/33.16

[58] Field of Search ..... 89/34, 33.14, 33.16, 89/33.1; 206/3

[56] References Cited

U.S. PATENT DOCUMENTS

| | | | |
|---|---|---|---|
| 1,808,106 | 6/1931 | Green | 89/33.14 |
| 2,386,894 | 10/1945 | Hartley | 89/33.16 |
| 2,398,263 | 4/1946 | Trimbach | 89/34 |
| 2,566,569 | 9/1951 | Jensen | 206/3 |
| 2,776,599 | 1/1957 | Starry | 89/34 |
| 2,889,751 | 6/1959 | Bilek | 89/34 |
| 3,602,088 | 8/1971 | Spring | 89/33.16 |
| 4,494,440 | 1/1985 | Koine | 89/33.16 |
| 4,574,683 | 3/1986 | LeBlanc | 89/34 |

FOREIGN PATENT DOCUMENTS

| | | | |
|---|---|---|---|
| 71002 | 6/1916 | Austria | 206/3 |
| 1934144 | 2/1971 | Fed. Rep. of Germany | 89/34 |
| 2437085 | 4/1975 | Fed. Rep. of Germany | 89/34 |
| 602587 | 5/1948 | United Kingdom | 89/34 |

*Primary Examiner*—Charles T. Jordan
*Assistant Examiner*—Stephen Johnson
*Attorney, Agent, or Firm*—Bailin L. Kuch; Robert A. Cahill

[57] ABSTRACT

An ammunition magazine assembly is provided with a plurality of permanent partitions for subdividing the magazine interior into a plurality of bays and a plurality of optional separators readily removably installed to subdivide selected bays into bay sections. The bays accommodate belts of large caliber ammunition, while the bay sections accommodate belts of small caliber ammunitions. The magazine box is further equipped with a plurality of operational exit ports, all capable of accepting either a modular closure cover or a modular feed chute for either large or small caliber ammunition. The magazine assembly is thus readily adapted to bidirectional feeding of an ammunition belt or belts of one caliber or bidirectional feeding of belts of different calibers.

13 Claims, 5 Drawing Sheets

MULTIPLY ADAPTABLE MAGAZINE ASSEMBLY

The present invention relates to containers for belted or linked ammunition serving a rapid-fire gun.

BACKGROUND OF THE INVENTION

A typical magazine or can for belted rounds of ammunition includes a plurality of partitions for subdividing the can interior into a plurality of bays. A continuous ammunition belt is arranged in the can with a multiplicity of folds or layers deposited in each bay and with the uppermost layer drawn over the top of a partition and extended downwardly to the bottom of the adjacent bay. The leading end of the ammunition belt is withdrawn through a feed chute affixed to the can at an exit port and out to the rapid-fire gun. When the ammunition belt is withdrawn by the gun or an intervening booster, the bays are emptied in succession. To reduce drag, the belt may be drawn over rollers positioned above the partitions, as disclosed in Trimbach U.S. Pat. No. 2,398,263.

Heretofore, ammunition cans have been configured and dimensioned to accommodate a particular gun station and caliber of ammunition. That is, ammunition cans for belted ammunition are specifically designed to handle one ammunition size, and their exit port is so located as to accommodate feeding of ammunition generally in one direction to a single gun. Thus, each unique gun station requires a different ammunition can design. This obviously complicates the logistics required to support these various gun stations in the field.

SUMMARY OF THE INVENTION

It is accordingly an object of the present invention to provide an improved ammunition magazine for belted ammunition.

A further object is to provide an ammunition magazine of the above-character which is readily adaptable to serving plural rapid-fire guns.

Another object is to provide an ammunition magazine of the above-character, which is readily adaptable to accommodate different calibers of ammunitions.

An additional object is to provide an ammunition magazine of the above-character, which is readily adaptable to concurrently serving different calibers of rapid-fire guns.

A still further object is to provide an ammunition magazine of the above-character, which includes a plurality of optional exit ports through which an ammunition belt or belts may be withdrawn in different feed directions.

Other objects of the invention will in part be obvious and in part appear hereinafter.

In accordance with the present invention, there is provided an ammunition magazine or can having a plurality of permanent partitions for subdividing the can interior into a plurality of bays and a plurality of optional separators which are readily installed to subdivide selected bays into bay sections. The bays accommodate belts of large caliber ammunition, while the bay sections accommodate belts of small caliber ammunition. The ammunition box is further equipped with a plurality of optional exit ports, all capable of accepting either a closure cover, a feed chute for a large caliber ammunition belt, or a feed chute for a small caliber ammunition belt.

By selectively installing the covers and a large caliber feed chute to the exit ports, the ammunition can is adapted to any one of a plurality of different belt feed directions. The installations of two large caliber feed chutes adopts the ammunition can to feeding separate ammunition belts to a pair of large caliber guns. If the separators and a small caliber feed chute are installed, the ammunition can is adapted to feeding a small caliber gun through any one of its optional exit ports. The installation of two small caliber feed chutes adapts the ammunition can to serving a pair of guns. If separators are selectively installed in less than all of the bays, and both a small caliber and a large caliber feed chute are installed to appropriate exit ports, the ammunition can is adapted to independently feed a belt of large caliber ammunition stored in its bays to one gun and a separate belt of small caliber ammunition stored in its bay sections to another gun.

The invention accordingly comprises the features of constructions, arrangements of parts, and combinations of elements, all of which as described below, and the scope of the invention will be indicated in the appended claims.

BRIEF DESCRIPTION OF THE DRAWINGS

For a full understanding of the nature and objects of the present invention, reference may be had to the following Detailed Description taken in conjunction with the accompanying drawings, in which.

Corresponding reference numerals refer to like parts throughout the several views of the drawings.

DETAILED DESCRIPTION

Figure 1:
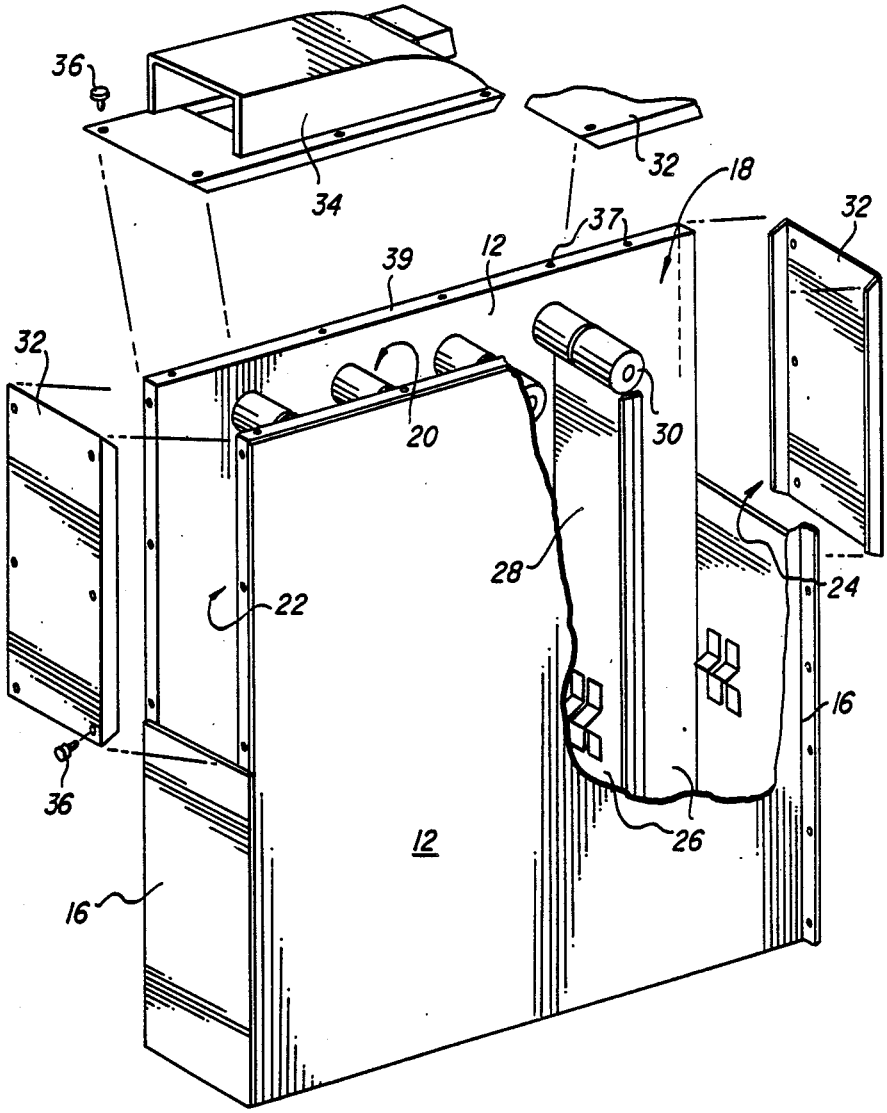
FIG. 1 is a perspective view, partially broken away, of an ammunition can constructed in accordance with the present invention and optionally adapted to accommodating belted rounds of large caliber ammunition.

The ammunition can of the present invention, generally indicated at 10 in FIG. 1, is of a longitudinally elongated, deep box-like shape having full height sidewalls 12, a bottom wall 14, and shortened endwalls 16 joined together by suitable means, such as welding or rivets, to provide a structurally rigid container structure. The ammunition can is devoid of a top wall as such, and thus its open top serves to provide at least a pair of optional top exit ports indicated at 18 and 20. In addition, the termination of the sidewalls short of the can top provides two additional optional exit ports, one at each upper end of the box as indicated at 22 and 24. The interior of the can is subdivided into a plurality of bays 26 by a series of transversely arranged partitions 28 affixed in place between sidewalls 12. Rotatably mounted by the sidewalls at positions above each partition are rollers 30 over which belted or linked ammunition is looped as seen in FIG. 2.

In accordance with a feature of the present invention, there are provided modular covers, indicated at 32 and modular feed chutes, indicated at 34, which are selectively installed to ammunition can 10 at exit ports 18, 20, 22 and 24, and thus to optionally adapt the ammunition can to a variety of rapid-fire gun station configurations. The covers and feed chute are affixed to the can spanning these exit ports by capture fasteners 36 releaseably engaging a series of holes 37 provided in outwardly turned flanges 39 integral with sidewalls 12.

As seen in FIG. 1, a feed chute 34 is installed over exit port 20, and covers are installed over the remaining exit ports 18, 22 and 24. Thus a single ammunition belt is withdrawn from can 10 through this feed chute to a rapid fire gun (not shown). It will be appreciated that the direction of belt feed can be readily changed to suit different gun configurations by installing the feed chute over the appropriate one of the exit ports and installing covers over the remaining exit ports.

Figure 2:
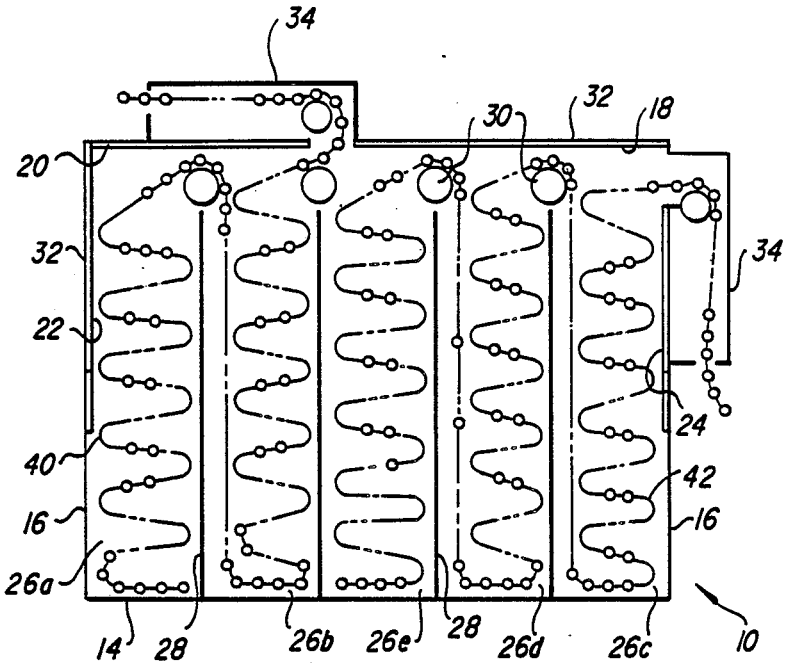
FIG. 2 is a side view in diagrammatic form illustrating the optional adaptation of the ammunition can of FIG. 1 to feeding separate large caliber ammunition belts in different feed directions.

It will be further appreciated that ammunition can 10 is readily optionally adaptable to independently serving two rapid-fire guns as seen in FIG. 2. As shown, feed chutes 34 are installed over exit ports 20 and 24, and covers 32 are installed over exit ports 18 and 22. One belt 40 of ammunition is loaded in the left two bays **26*a* and 26*b* with its leading fed out through the feed chute installed over exit port 20. A separate belt 42 is loaded into the three right bays 26*c*, 26*d* and 26*e* with its leading end brought out through the feed chute installed over exit port 24. As belt 40 is withdrawn, bay 26*b* is emptied first and then bay 26*a*. Rollers 30 serve to reduce belt drag during withdrawal. Similarly, withdrawal of belt 42 empties bay 26*c*, followed by bay 26*d* and then bay 26*e***. Again, the feed chutes can readily switch places with covers to change the general direction of ammunition belt feed to suit the particular gun station configuration to be served.

Figure 3:
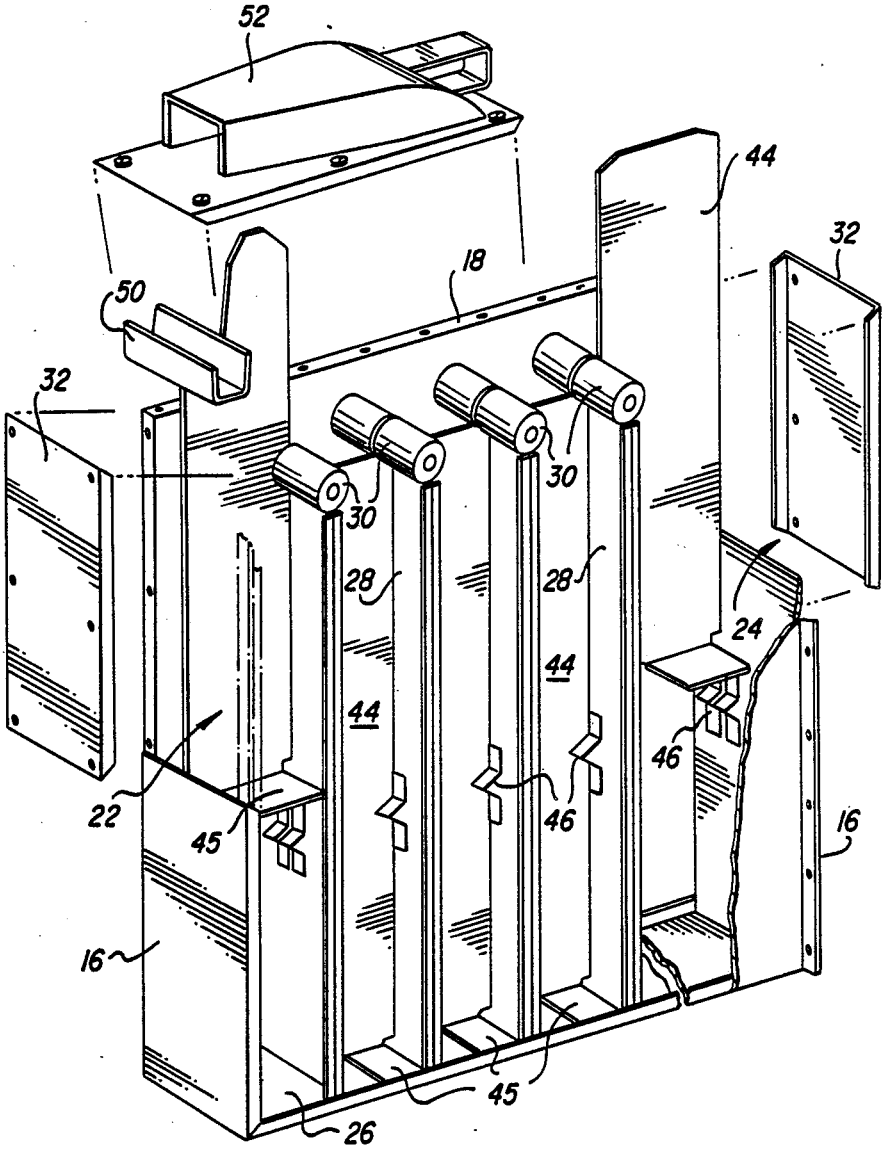
FIG. 3 is a perspective view, partially broken away, of the ammunition can of the present invention optionally adapted to accommodate belted rounds of small caliber ammunition.

FIG. 3 illustrates ammunition can 10 optionally adapted to accommodate belted ammunition of a smaller size or caliber. To this end, separators 44 are installed to longitudinally span the separation between partitions 28 and thus subdivide bays 26 into bay sections. To accommodate this installation, partitions 28 and endwalls 16 carry channel brackets 46 through which the vertical edges of the separators slide. A foot plate 45 is affixed to the lower end of each separator to rest on bottom wall 14 and span the separation between sidewalls 12 for added stability. Rollers 30 are in the form of split halves to provide a gap in which the edge portions of the separators are received as they are inserted vertically downward into installed positions. The separator installed in at least one of the end bays has its upper end portion modified so as to carry a transversely extending crossover bin 50 for supporting the transition of a belt of small caliber ammunition between transversely adjacent bay sections. Covers 32 are installed to those exit ports which are not to be used, and a feed chute 52, sized to the smaller ammunition caliber, is installed over each exit port through which an ammunition belt is to be withdrawn.

Figure 5:
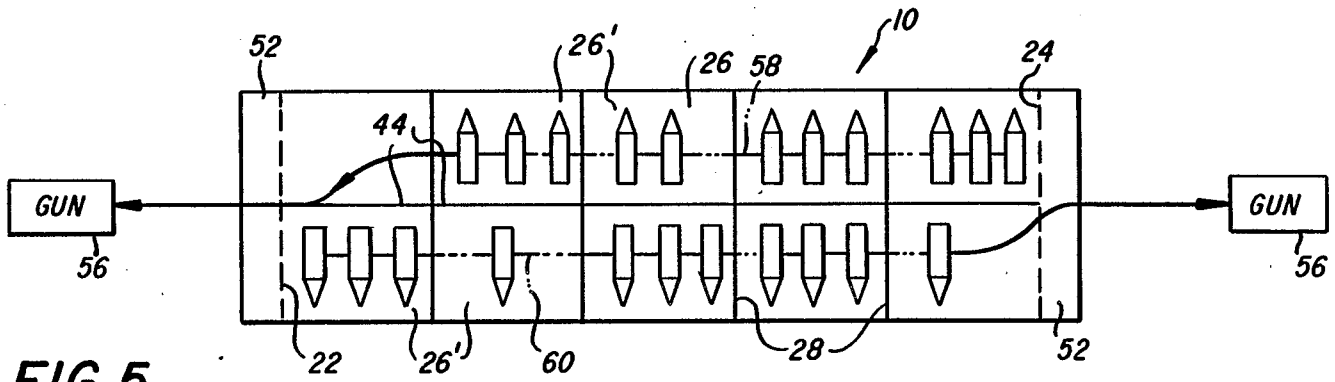
FIG. 5 is a top view in diagrammatic form of the ammunition can of FIG. 3 adapted to feeding two belts of small caliber ammunition in different directions.
Figure 4:
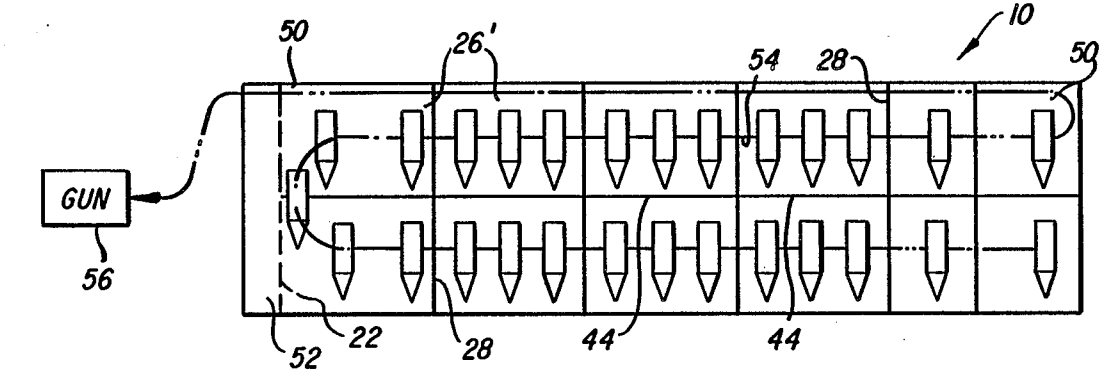
FIG. 4 is a top view in diagrammatic form, illustrating the adaptation of the ammunition can of FIG. 3 to feeding a small caliber ammunition belt in a selected feed direction.
Figure 6:
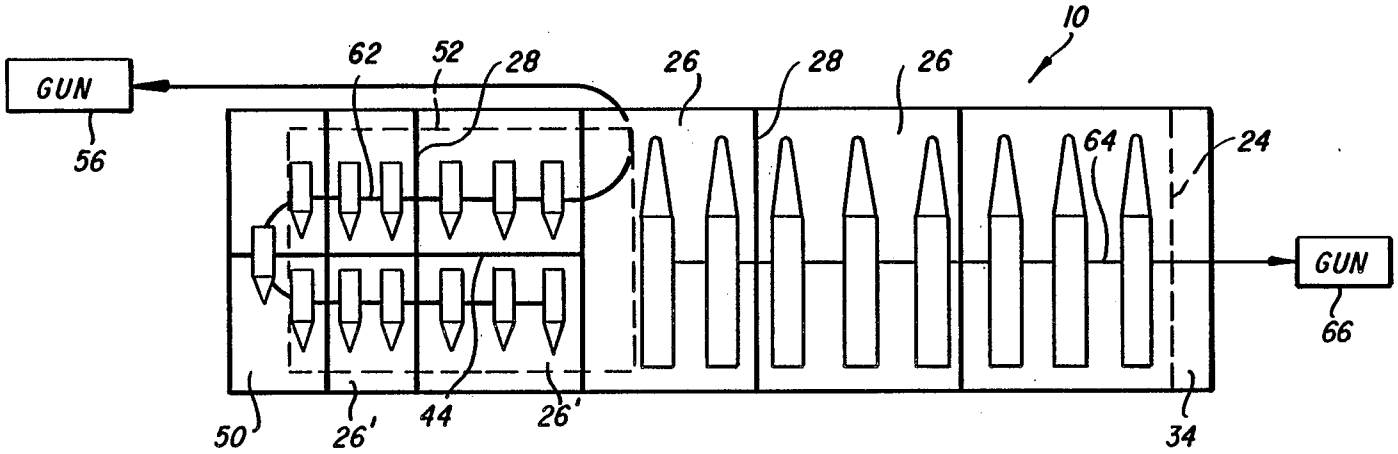
FIG. 6 is a top view in diagrammatic form illustrating the adaptation of the ammunition can of the present invention to accommodate separate belts of large and small caliber ammunition being feed in different directions.

Several of the many possible adaptations of ammunition can 10 made possible by the installation of separators 44 are diagrammed in FIGS. 4–6. FIG. 4 shows the ammunition can adapted to feeding one continuous belt 54 of small caliber ammunition, such as 7.62 mm rounds, to a single gun 56. This belt is loaded into bay sections 26' progressively from the right end to the left end along one side of the can, crossed over to the bay sections on the other side of the can via crossover bin 50, and loaded into these bay sections progressing left to right. The leading end of the belt is brought back over the last filled bay sections and led out through a feed chute 52 installed to exit port 22.

FIG. 5 illustrates ammunition can 10 optionally adapted to independently serve two small caliber rapid-fire guns 56. One ammunition belt 58 is loaded into the bay sections 26' along one side of the can and withdrawn to feed one gun 56 through a feed chute 52 installed to exit port 22 in the left end of the can. A second ammunition belt 60 is loaded in the bay sections along the other side of the can with its leading end fed out through a feed chute 52 installed over right end exit port 24 and on to a second gun 56. It will be appreciated that one or both feed chutes could be installed over the top exit ports 18 and 20. The unused exit ports are of course closed off with covers 32.

FIG. 6 illustrates an adaptation of ammunition can 10 to serving two guns of different calibers. Thus, separators 44 are installed in the left two bays to provide bay sections 26' into which a belt 62 of small caliber ammunition , e.g., 7.62 mm, is loaded. The belt transition between bay sections at the left end of the can is supported by the installed crossover bin 50. The leading end of this belt is fed out to gun 56 through a feed chute 52 (illustrated in phantom outline) installed over exit port 20.

The three right bays 26 are not subdivided by separators, and thus can be loaded with a belt 64 of larger ammunition, e.g. 50 caliber, with its leading end fed out to a gun 66 through a feed chute 34 installed over exit port 24 as shown or optionally over exit port 18 (FIG. 1).

The ammunition can of the present invention is thus seen to be readily multiply adapted to a single belt feed configuration in a plurality of optional directions or to a dual belt feed configuration also in a plurality of optional directions, either with ammunition of the same or different calibers. It will be appreciated that the feed direction is selectable depending upon which of the exit ports the feed chutes are applied and also upon which of two possible orientations the feed chutes are installed. Thus, the ammunition can of the present invention is virtually universally adaptable to a wide variety of gun configurations.

From the foregoing, it is seen that the objects set forth above, include those made apparent in the Detailed Description, are efficiently attained, and, since certain changes may be made in the constructions set forth without departing from the invention, it is intended that all matters of detail be taken as illustrative and not in a limiting sense.

Having described the invention, what is claimed as new and desired to secure by Letters Patent is:

1. A magazine assembly for belts of ammunition, said assembly comprising, in combination:

A. a container including opposed sidewalls, a bottom wall, and first and second opposed endwalls all in conjoined relation to provide a box-like structure having an open top, said first endwall having an opening therein adjacent said open top to provide a first exit port, said second endwall having an opening therein adjacent said open top to provide a second exit port, said open top providing at least third and fourth exit ports in contiguous relation;

B. a plurality of longitudinally spaced partitions spanning said sidewalls to provide a plurality of bays within said container for accommodating at least one ammunition belt;

C. a separate feed chute affixed to said container at each of those said exit ports through which an ammunition belt is to be withdrawn from said container; and D. a separate modular cover affixed to said container in closure relation with each of those said exit ports through which no ammunition belt is to be withdrawn.

2. The magazine assembly defined in claim 1 wherein a said separate feed chute is affixed to each of any two said exit ports to accommodate independent withdrawal of two separate ammunition belts from said container respectively through said any two said exit ports.

3. The magazine assembly defined in claim 1, which further includes individual separators removably installed in positions between and orthogonal to selected pairs of adjacent said partitions to subdivide said bays into transversely arranged bay sections.

4. The magazine assembly defined in claim 3, which further includes brackets carried by said partitions for slidingly receiving said separators.

5. The magazine assembly defined in claim 4, which further includes a foot plate affixed to a lower end of each of said separators to stabilize installed positions thereof.

6. The magazine assembly defined in claim 3, wherein a separate said feed chute is affixed at any two of said exit ports, each said feed chute respectively structured to accommodate independent withdrawal of ammunition belts of different calibers respectively through said any two said exit ports.

7. The magazine assembly defined in claim 3, which further includes a crossover member installed in said container for supporting an ammunition belt in transition between said bay sections of a subdivided one of said bays.

8. The magazine assembly defined in claim 7, wherein said crossover member is carried at an upper end of one of said separators.

9. The magazine assembly defined in claim 7, which includes a first said feed chute and a second said feed chute, said first feed chute affixed at one of said exit ports to accommodate withdrawal of a belt of large caliber ammunition for said bays, and said second feed chute affixed at another one of said exit ports to accommodate withdrawal of a belt of small caliber ammunition from said bay sections.

10. The magazine assembly defined in claim 1, which further includes a separate roller mounted between said sidewalls immediately above each of said partitions to facilitate withdrawal of an ammunition belt from said bays.

11. A method for adapting an ammunition container to a variety of optional ammunition belt feeding configurations including the steps of:

A. providing a first exit port in a first ammunition container endwall,

B. providing a second exit port in a second ammunition container endwall,

C. providing at least a third exit port at an open top of the ammunition container;

D. affixing a plurality of partitions within the ammunition container in longitudinally spaced relation to provide a plurality of bays for accommodating at least one ammunition belt;

E. providing a plurality of modular feed chutes;

F. providing a plurality of modular covers;

G. affixing one of said modular feed chutes to the ammunition container at each of said exit ports through which an ammunition belt is to be withdrawn; and H. affixing one of said modular covers to the ammunition container in closure relation with each of said exit ports through which an ammunition belt is not to be withdrawn.

12. The method defined in claim 11, which further includes the step of installing removable separators between and orthogonal to selected pairs of adjacent said partitions to subdivide said bays into transversely arranged bay sections for accommodating a belt of small caliber ammunition, leaving any non-subdivided said bays to accommodate a belt of large caliber ammunitions.

13. The method defined in claim 12, which further includes the step of installing a crossover member with one of said separators for supporting the belt of small caliber ammunition in transition between said bay sections of a subdivided one of said bays.

* * * * *